United States Patent [19]

Matsubara et al.

[11] Patent Number: 4,565,331

[45] Date of Patent: Jan. 21, 1986

[54] THREAD ANCHORING METHOD AND APPARATUS FOR USE IN WINDER

[75] Inventors: Susumu Matsubara; Shouetsu Nitta; Kiyoaki Hashiba; Yuuichi Noguchi, all of Toyama, Japan

[73] Assignee: Yoshida Kogyo K.K., Tokyo, Japan

[21] Appl. No.: 656,773

[22] Filed: Oct. 1, 1984

[30] Foreign Application Priority Data

Oct. 3, 1983 [JP] Japan ..... 53-184881

[51] Int. Cl.[4] ..... B65H 54/02; B65H 54/26

[52] U.S. Cl. ..... 242/18 PW; 242/35.5 A

[58] Field of Search ..... 242/18 PW, 18 A, 35.5 A

[56] References Cited

U.S. PATENT DOCUMENTS

| | | | |
|---|---|---|---|
| 4,069,983 | 1/1978 | Muramatsu et al. | 242/18 PW |
| 4,079,898 | 3/1978 | Murakami et al. | 242/35.5 A |
| 4,116,395 | 9/1978 | Courvoisier | 242/35.5 A |
| 4,154,409 | 5/1979 | Reisser et al. | 242/18 PW |
| 4,158,444 | 6/1979 | Krauss | 242/18 PW |
| 4,324,368 | 4/1982 | Inouye et al. | 242/18 PW |
| 4,437,617 | 3/1984 | Cardell | 242/18 PW X |
| 4,451,007 | 5/1984 | Ohkubo et al. | 242/18 PW X |
| 4,466,575 | 8/1984 | Husges et al. | 242/18 PW |
| 4,477,033 | 10/1984 | Kotzur et al. | 242/18 PW X |
| 4,491,282 | 1/1985 | Hubner | 242/18 PW X |

*Primary Examiner*—Stanley N. Gilreath

*Attorney, Agent, or Firm*—Hill, Van Santen, Steadman & Simpson

[57] ABSTRACT

An improved method and apparatus for a winder for anchoring an indefinite length of thread supplied from a supply source onto an anchoring disc in said winder. The method comprises the steps of offsetting the thread to a position facing the anchoring disc, spanning the thread vertically, arresting the spanned thread, protruding the thread outwardly from the disc, and displacing the thread slantly across the anchoring disc so as to anchor the thread to the disc. The apparatus comprises a traverse guide, a carriage movable parallel to the traverse guide, a thread offsetting mechanism including a thread offsetting guide for moving a thread being supplied between the opposite out sides of the traverse range of the thread, a thread spanning mechanism for spanning the thread vertically, and a thread anchoring mechanism for anchoring the thread to an anchoring disc in a winder, the thread offsetting mechanism, the thread spanning mechanism and the thread anchoring mechanism being provided on the carriage.

14 Claims, 24 Drawing Figures

THREAD ANCHORING METHOD AND APPARATUS FOR USE IN WINDER

BACKGROUND OF THE INVENTION

This invention relates to an improved method and apparatus for anchoring a thread to a winder in order to wind the thread supplied from a supply source about an empty bobbin which has replaced a full bobbin in the winder. The purpose of the present invention is to provide a method and apparatus in which the thread from the supply source can be automatically wound about the empty bobbin, with a doffer device for doffing a full bobbin and replacing it with an empty bobbin being disposed in front of the winder, the thread being positively caught and anchored on the empty bobbin during the anchoring operation without any interference between the thread anchoring member and the empty bobbin.

A prior art thread anchoring method and apparatus of this type have been disclosed in Japanese Laid-Open Patent Application No. 70137/1977, but in the disclosed method and apparatus, a thread anchoring guide having a substantially U-shaped thread arresting piece is rocked in a horizontal plane and the thread anchoring apparatus itself requires a suction tank, which makes the apparatus bulky. A large space is required in front of the winder for disposing the thread anchoring apparatus and thus, the prior art method and apparatus have the disadvantages that doffing and bobbin exchange operations have to be performed behind the winder. In addition, since the thread anchoring guide employs two substantially U-shaped thread arresting pieces for arresting the thread supplied from the supply source at two points in order to wind the thread about an empty bobbin, the path of the thread to be arrested by the thread anchoring guide and the position of the thread anchoring guide must be very precise, the path of the thread is rigidly limited, and the thread arresting piece adjacent to the body of the bobbin tends to interfere with the body of the bobbin when the thread is wound about the bobbin.

SUMMARY OF THE INVENTION

According to the method of the present invention, thread extending from a thread guide to an empty bobbin is offset along and over a traverse guide to a position facing a thread anchoring disc positioned at one end of the empty bobbin; the thread is then spanned vertically with the path of the thread regulated and the thus spanned thread is arrested at one point, projected outwardly beyond the side of the thread anchoring disc, and displaced slantly from the outer side of the disc to the empty bobbin in a horizontal plane to thereby anchor the thread to the anchoring portion of the disc. The thread extending from the thread guide to the anchoring portion is then engaged to the traverse means and said arresting of the thread is released. Thus, excessive space is not required in front of the winder, thread anchoring can be performed with no interference between the thread anchoring member and bobbin, and the path of the thread and the position of the thread anchoring member are not rigidly limited, but may be freely set.

According to the apparatus of the present invention, a carriage is movable parallel to a traverse guide positioned in front of a winder and a thread offsetting mechanism, a thread spanning mechanism, and a thread anchoring mechanism are disposed on the carriage. The thread offsetting mechanism is provided with a thread offsetting guide for engaging the thread being supplied and drive means for reciprocally moving the thread offsetting guide between two positions, one of which is within the traverse range of the thread and the other of which is the position in which the thread offsetting guide faces the thread anchoring disc at the end of the empty bobbin. The thread spanning mechanism is disposed in a position facing the thread offset to a position facing the thread anchoring disc by the thread offsetting mechanism, and is provided with a thread spanning guide adapted to engage the thread being supplied and drive means for moving the spanning guide vertically so as to stretch the thread vertically in the raised position of the spanning guide. The thread anchoring mechanism is disposed in a position facing the thread stretched vertically by the thread spanning mechanism, and is provided with a substantially L-shaped thread anchoring guide consisting of a thread arresting piece having a groove for arresting the spanned thread and a thread guide piece extending from the base end of the thread arresting piece at right angles thereto. A drive means is provided for reciprocally moving the thread anchoring guide between the retracted position, in which the guide is on the carriage, and the advanced position, in which the thread arresting piece is positioned outwardly of the thread anchoring disc; means is provided for rotating the thread anchoring guide between a first position, in which the thread guide piece assumes a vertical position, and a second position, in which the thread guide piece assumes a substantially horizontal position; and the advanced position of the thread anchoring guide is so designed that the thread extending from the thread arresting piece to the thread guide piece intersects the thread anchoring disc, whereby doffing of a full bobbin and setting of an empty bobbin can be performed in front of a winder and the entire thread anchoring apparatus can be made relatively small and perform thread anchoring automatically and efficiently.

The above and other objects and attendant advantages of the present invention will be more readily apparent to those skilled in the art from a reading of the following detailed description in conjunction with the accompanying drawings, which show one preferred embodiment of the invention for the purpose of illustration only, not limiting the scope of the invention in any way.

BRIEF DESCRIPTION OF THE DRAWINGS

The accompanying drawings show one preferred embodiment of a thread anchoring apparatus constructed in accordance with the principles of the present invention in which.

PREFERRED EMBODIMENTS OF THE INVENTION

Figure 1:
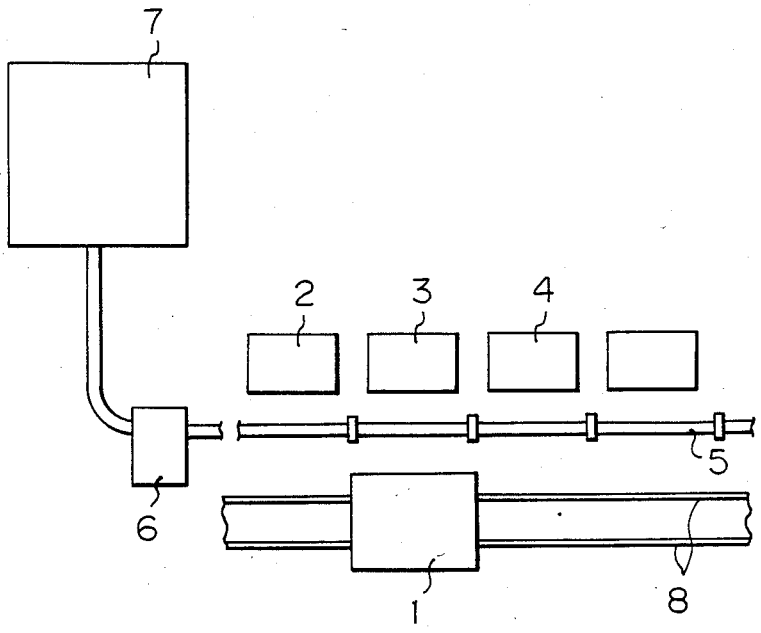
FIG. 1 is a layout showing the arrangement relationship between the thread anchoring apparatus and winders.

The present invention will be now described referring to the accompanying drawings and more particularly, to FIG. 1 thereof which is a layout showing the relationship between a carriage 1 on which the thread anchoring apparatus of the present invention is mounted and winders 2, 3, 4 . . . fixedly secured to a floor in a row. A traverse guide 5 is fixedly secured to the floor in front of the row of the winders 2, 3, 4 . . . parallel to and spaced from the winder row. The traverse guide 5 is in the form of an elongated hollow member, the hollow interior of which is in communication with a vacuum tank 7 through a suction force amplifier 6 mounted on the traverse guide 5.

Rails 8 are laid on the floor on the side of the traverse guide 5 opposite from the row of the winders 2, 3, 4 . . . parallel to and spaced from the guide 5, and the carriage 1 is mounted on the rails 8 to freely run along them.

The carriage 1 is so designed that whenever one particular winder of the winders 2, 3, 4 . . . in the row produces a full bobbin signal, the carriage runs to and stops in front of that particular winder under the control of a control means (not shown).

Figure 2:
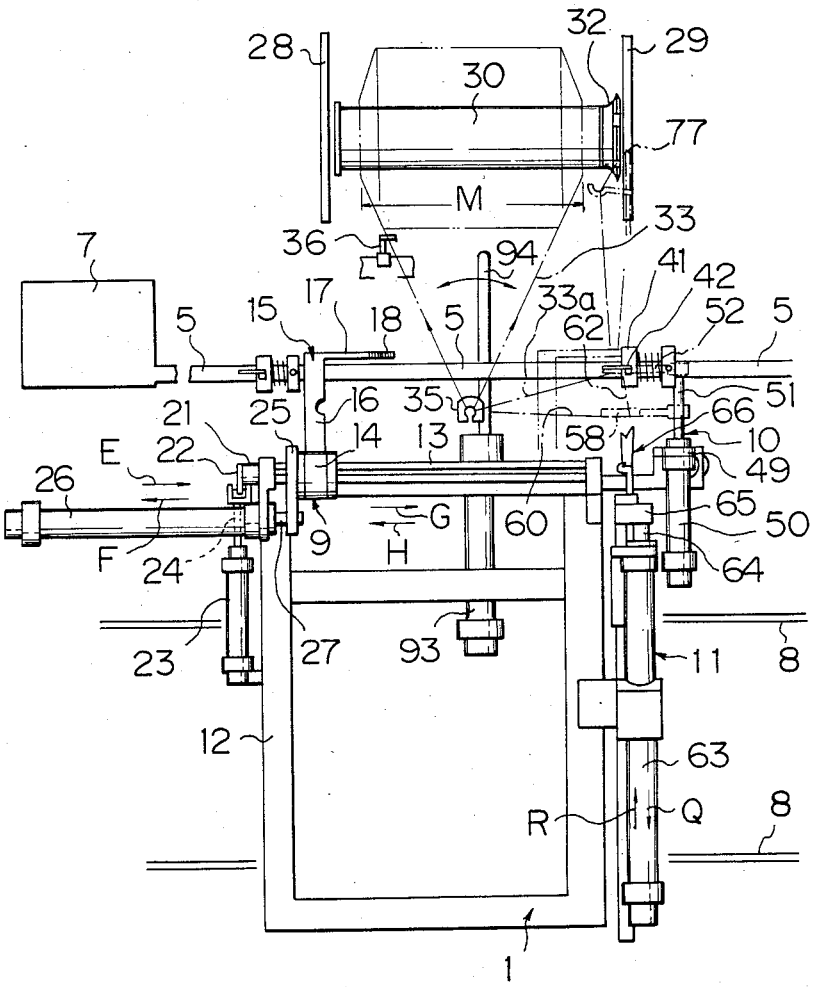
FIG. 2 is a top plan view of the apparatus and one of the winders.
Figure 3:
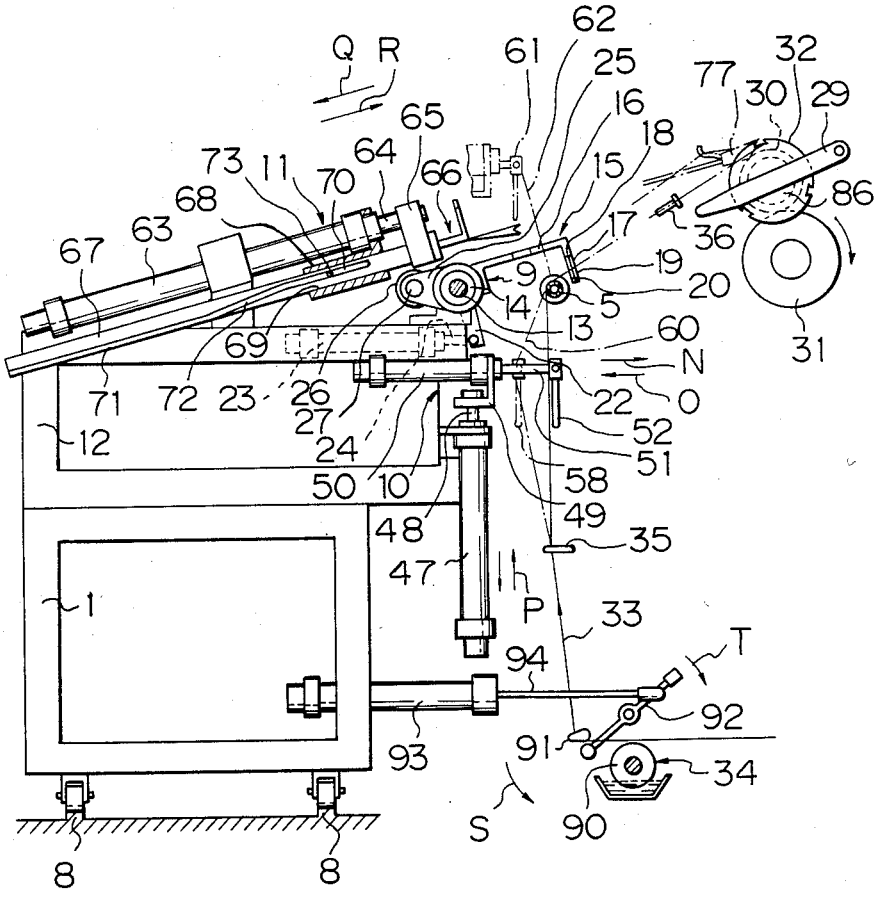
FIG. 3 is a side elevational view of the apparatus and winder.
Figure 4:
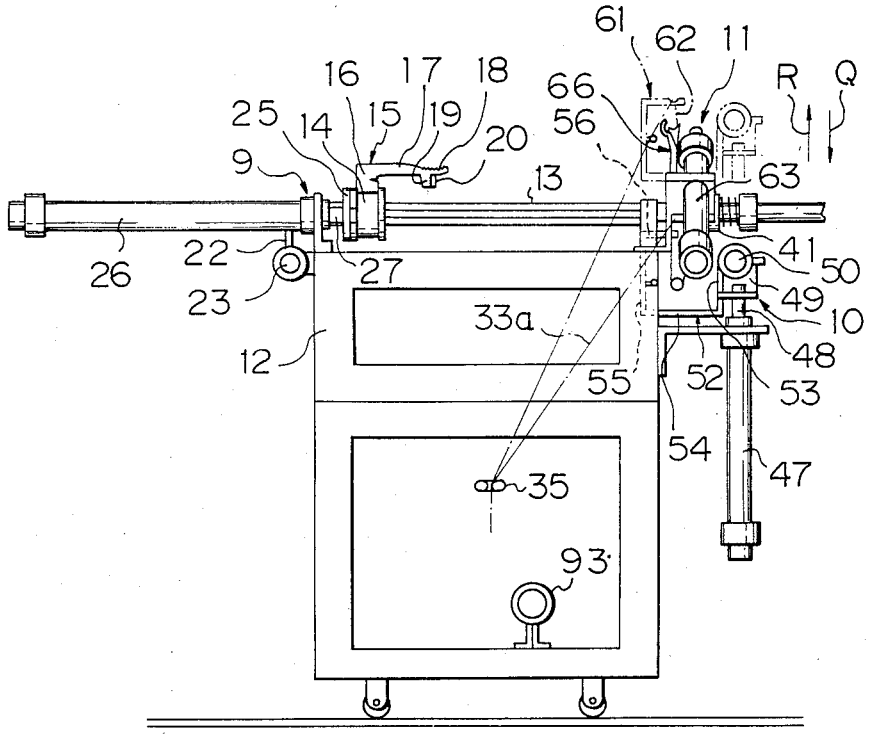
FIG. 4 is a front elevational view of the apparatus.

As shown in FIGS. 2, 3 and 4, a thread offsetting mechanism 9, a thread spanning mechanism 10 and a thread anchoring mechanism 11 are suitably mounted on the carriage 1.

As more clearly shown in FIGS. 2 to 10 inclusive, the thread offsetting mechanism 9 has a spline shaft 13 pivoted to the framework 12 of the carriage 1 and supporting a slide 14 thereon for slidable movement. The slide 14 has a thread offsetting guide 15 secured thereto.

As more clearly shown in FIGS. 5 to 10 inclusive, the thread offsetting guide 15 includes an arm 16 extending above and transversely from the traverse guide 5 and a bent piece 17 extending downwardly from the free end of the arm 16 and then parallel to the traverse guide 5. The upper surface of the bent piece 17 is formed with saw teeth 18 and a thread pusher piece 19 is formed on the bent piece on the underside of the saw teeth and in a position nearer to the arm 16 than to the saw teeth 18. The leading end of the thread pusher piece 19 is formed with blade portion 20.

The spline shaft 13 includes a plain end portion 21 extending beyond the framework 12 of the carriage 1. A connector bar 22 is fixed to one end portion thereof by the end portion 21 of the spline shaft 13 for unitary rotation with the shaft, and the bar is pivoted at the other end to a U-shaped bracket 22*a* through a slot formed in the bar. The bracket 22*a* is fixed to the end of the piston rod 24 of a drive cylinder 23 secured to the carriage framework 12.

Figure 5:
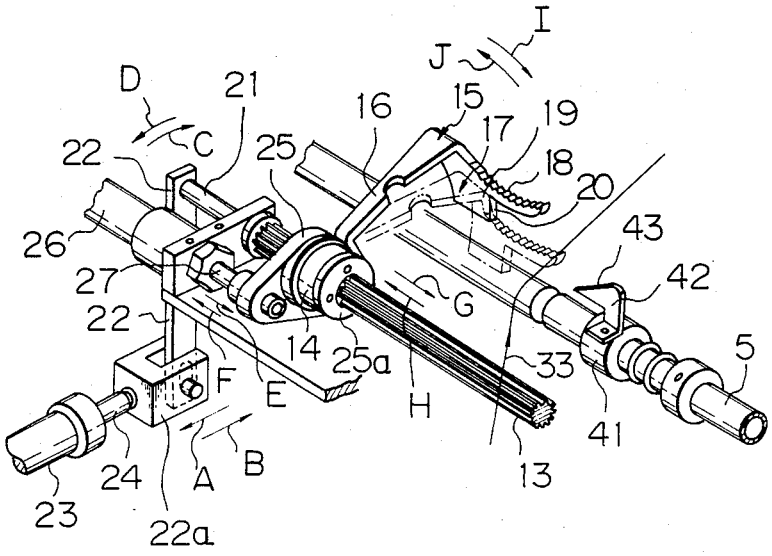
FIG. 5 is a perspective view of the thread offsetting mechanism of the apparatus.
Figure 6:
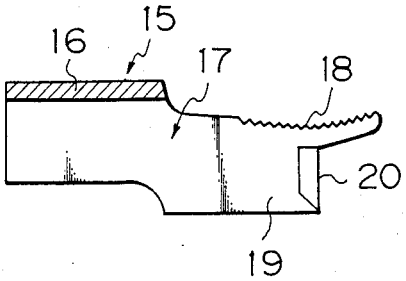
FIG. 6 is a fragmentary front elevational view of the thread offsetting guide of the apparatus with a portion thereof broken away.
Figure 7:
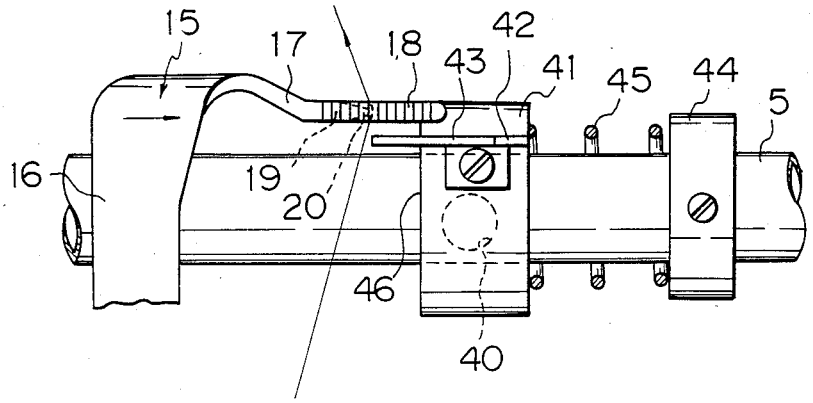
FIGS. 7, 8 and 9 are fragmentary plan views showing successive steps in the thread offsetting operation.

Thus, as more clearly shown in FIG. 5, as the piston rod 24 retracts and extends as shown by arrows A and B, respectively, the spline shaft 13 rotates in the directions shown by arrows C and D, respectively.

The slide 14 slidably mounted on the spline shaft 13 is rotatably embraced by a bracket 25 which is in turn secured to the piston rod 27 of a drive cylinder 26 secured to the carriage framework 12 in parallel and spaced relationship to the spline shaft 13. The bracket 25 is freely rotatable relative to the spline shaft 13. A holding plate 25*a* is connected to the bracket 25 by means of pins which pass through an arcuate groove formed in the slide 14 for rotatably hold the slide 14 against the bracket 25.

Thus, as is clear from FIG. 5, as the piston rod 27 extends and retracts as shown by arrows E and F, the bracket 25 and the slide 14 embraced by the bracket advance and retract as shown by arrows G and H along the spline shaft 13.

The retraction of the piston rod 24 of the drive cylinder 23 in the arrow A direction rotates the spline shaft 13 in the arrow C direction through the connector bar 22 and when the piston rod 24 has completed its retraction movement, the thread offsetting guide 15 secured to the slide 14 rotates in the arrow I direction to assume a position in which the guide straddles the traverse guide 5, as shown by the chain line in FIG. 5, and the bent piece 17 assumes a position in which the piece is positioned more adjacently to the periphery of the traverse guide 5 on the side of the winder. On the other hand, when the piston rod 24 extends as shown by the arrow B, the spline shaft 13 is rotated in the arrow D direction through the connector bar 22; and when the piston rod has completed its advancing movement, the thread offsetting guide 15 mounted on the slide 14 rotates in the arrow J direction to assume a nonoperative position far above the traverse guide 5, as shown by the solid line in FIG. 5.

As is more clearly shown in FIGS. 2 and 3, each of the winders 2, 3, 4 . . . comprises a bobbin 30 detachably supported on a pair of spaced parallel bobbin support frames 28, 29. A thread anchoring disc 32 is mounted at one end or the righthand end of the bobbin as shown in FIG. 2 and is driven together with the bobbin 30 by means of a drive roll 31.

A length of thread 33 is supplied from a thread supply source such as a spinning device (not shown) and is passed through an oiling means 34 and a stationary thread guide 35 to the traverse guide 5, from which the thread 33 is taken up on the bobbin 30 while being traversed by a traverse means 36.

Figure 11:
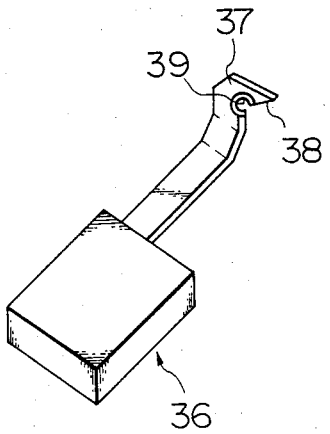
FIG. 11 is a perspective view of the thread guide portion of the traverse means of the apparatus.
Figure 12:
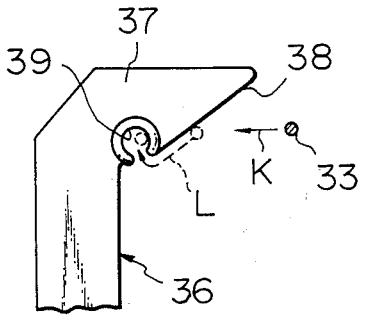
FIG. 12 is a fragmentary plan view on an enlarged scale of the thread guide portion as shown in FIG. 11.

One example of the thread guide portion 37 of the traverse means 36 has a construction as shown in FIGS. 11 and 12. The illustrated thread guide portion 37 has a sloped undersurface 38 sloping inwardly and downwardly and having a downwardly open guide recess 39 so that when the thread 33 is urged in the arrow K direction against the sloped undersurface 38, the thread automatically slides down the sloped undersurface 38 in the arrow I direction until the thread 33 enters the recess 39.

In FIG. 2, reference character M denotes the traverse range of the thread 33 fed from the supply source (not shown).

As is more clearly shown in FIGS. 7 to 10 inclusive, the hollow traverse guide 5 is formed with a suction hole 40 which is aligned with the anchoring disc 32. When the apparatus is at rest, a sleeve 41 slidably mounted on the traverse guide 5 closes the suction hole 40.

Secured to an upper portion of the sleeve 41 is a guide piece 42 which projects parallel to the axis of the bobbin and has a ramp 43 on a portion of the top thereof sloping downwardly towards the bobbin 30. Secured to the traverse guide 5 is a stop ring 44 which is laterally spaced from the sleeve 41 opposite to the side from which the guide piece projects. A coil spring 45 is interposed between the sleeve 41 and stop ring 44 to normally urge the sleeve 41 to the position for closing the suction hole 40. When the sleeve 41 is subjected to a force acting in the direction for compressing the spring 45, the sleeve 41 slides along the traverse guide 5 while compressing the coil spring 45 to uncover the suction hole 40 so that the suction force from the vacuum tank 7 acts through the suction hole 40. As mentioned hereinabove, since the piston rod 27 of the drive cylinder 26 is operatively connected to the bracket 25 embracing the slide 14 on the spline shaft 13, when the piston rod 27 fully extends in the arrow E direction (FIG. 5), it causes the thread offsetting guide 15 rotated to the chain line position in FIG. 5 to abut against the sleeve 41 on the traverse guide 5 across the traverse range M of the thread 33 to thereby forcibly slide the sleeve 41 along the traverse guide 5 to the position where the sleeve 41 uncovers the suction hole 40; and the retraction movement of the piston rod 27 in the arrow F direction moves the guide 15 beyond the limit of the traverse range M of the thread 33 on the side opposite from the sleeve 41.

The abutment of the thread offsetting guide 15 against the sleeve 41 to forcibly slide the latter is effected by the blade portion 20 on the thread pusher piece 19 of the guide 15 as shown in FIGS. 7 to 10 inclusive. The tip of the blade portion 20 is adapted to contact one side 46 of the sleeve 41.

When the piston rod 27 has reached the end of its extending movement in the arrow E direction as mentioned hereinabove, the thread offsetting guide 15 engages the thread 33 as shown in FIG. 3 to offset the thread 33 to the position shown by reference numeral **33*a* in FIGS. 2 and 4 and by reference numeral 33 in FIG. 8, respectively. This position corresponds to the position in which the thread aligns with the thread anchoring disc 32**.

The construction of the thread spanning mechanism 10 mounted on the carriage 1 will be now described.

As is more clearly shown in FIGS. 3 and 4, the thread spanning mechanism 10 has a vertical drive cylinder 47 on the side of the framework 12 of the carriage 1 adjacent to the thread anchoring disc 32. The upper end of the piston rod 48 of the drive cylinder 47 has a bracket 49 secured thereto and a horizontal drive cylinder 50 is secured to the bracket 49 with the piston rod 51 of the cylinder extending at right angles to the traverse guide 5.

Figure 13:
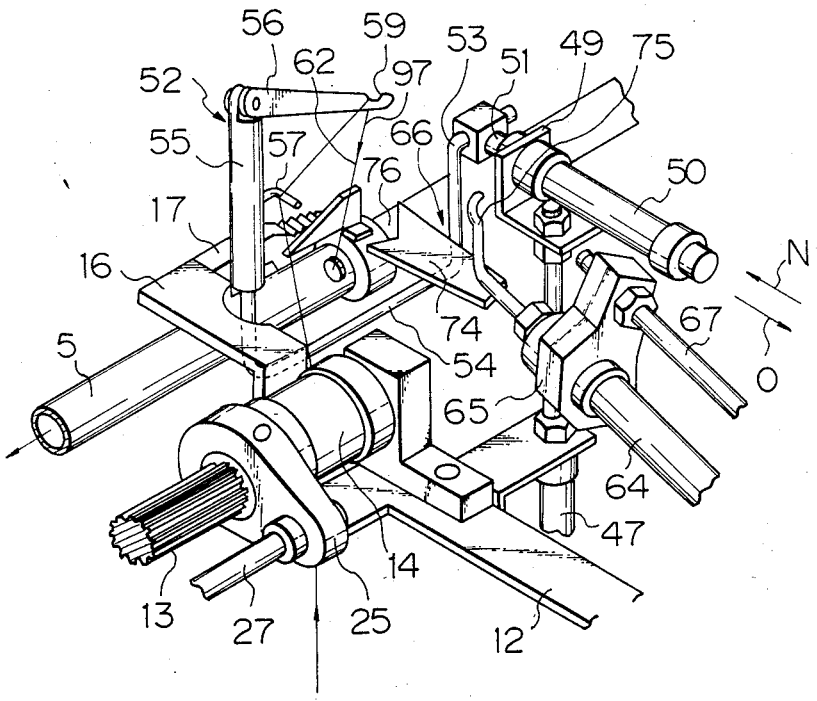
FIG. 13 is a perspective view of the thread spanning mechanism of the apparatus showing the mechanism in its operative condition.
Figure 14:
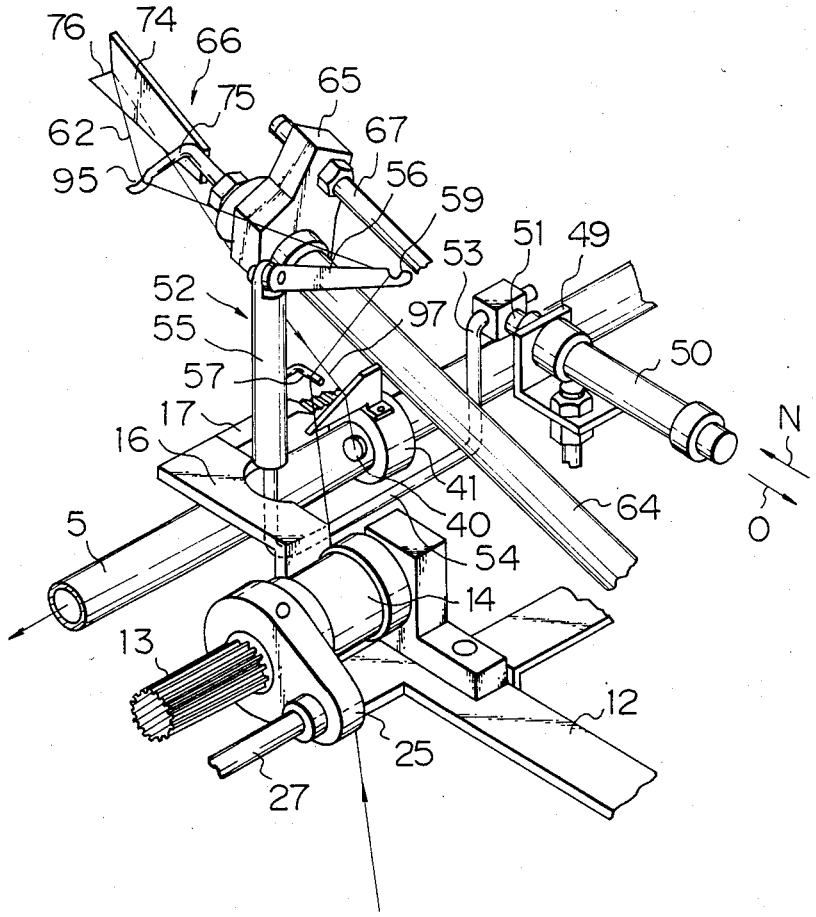
FIG. 14 is a perspective view of the thread anchoring mechanism of the apparatus showing the mechanism in its operative condition.

As is more clearly shown in FIGS. 13 and 14, the outer end of the piston rod 51 has a substantially U-shaped thread spanning guide 52 secured thereto.

The thread spanning guide 52 has a first rod portion 53 extending downwardly from one extreme end of the piston rod 51 at right angles to the traverse guide 5, a second rod portion 54 extending horizontally from the lower end of the first rod portion 53 toward the thread offsetting mechanism 9, and a third rod portion 55 extending upwardly from the end of the second horizontal rod portion 54 at right angles to the traverse guide 5. Pivoted to the free end of the third rod portion 55 is a thread spanning rod 56 sloping downwardly towards the first rod portion 53. A thread guide 57 projects horizontally from the third rod portion 55 in parallel to the piston rod 51.

The drive cylinder 50 and piston rod 51 normally assume the extended position as shown by the arrow N in which the thread spanning guide 52 is positioned directly below the traverse guide 5. In operation, the piston rod 51 retracts in the arrow O direction to guide the thread spanning guide 52 to a position as shown by reference numeral 58 in FIGS. 2 and 3.

When the thread spanning guide 52 is positioned directly below the traverse guide 5 as shown by reference numeral 52 in FIGS. 2 and 3, the guide 52 does not interfere with the thread 33 being taken up.

When the thread 33 is offset by the thread offsetting mechanism to a position as shown by reference numeral **33*a* in FIGS. 2 and 4 where the thread aligns with the thread anchoring disc 32, the projections of the vertical and horizontal portions of the thread 33*a* intersect the thread spanning rod 56 of the thread spanning guide 52**.

Thus, after the thread 33 has been offset to the position shown by reference numeral **33*a*, when the piston rod 51 of the drive cylinder 50 retracts in the arrow O direction to guide the thread spanning guide 52 to a position as shown by reference numeral 58 in FIGS. 2 and 3, the thread 33*a* is hitched over the thread guide 57 and then slide down the sloped thread spanning rod 56 until the thread enters the guide recess 59 at the leading end of the rod. In this way, the thread is anchored as shown by reference numeral 60 in FIGS. 2 and 3**.

The position of the guide recess 59 in the thread spanning rod 56 is aligned with the position of the thread anchoring disc 32 on one end of the associated winder.

When the piston rod 48 of the drive cylinder 47 associated with the thread spanning mechanism 10 extends or rises as shown by reference character P, the thread spanning guide having the thread anchored thereto as shown by 60 is moved from a position as shown by reference numeral 58. When the piston rod 48 has completed its rising movement in the arrow P direction, the thread spanning guide 53 assumes a position as shown by reference numeral 61 in FIGS. 3 and 4 above the thread arresting piece 74 on the thread anchoring guide 66 of the thread anchoring mechanism 11, of which description will be made hereinafter.

As will be made clearer hereinafter, when the thread spanning guide 52 is guided to a position as shown by reference numeral 61, the path of the thread as shown by reference numeral 60 is regulated from above and below between the suction hole 40 in the traverse guide 5 and the thread spanning guide so that the thread is spanned or stretched as shown by reference numeral 62.

As mentioned hereinabove, the thread anchoring mechanism 11 is mounted on the framework 12 of the carriage 1 in opposition to the thread 62 vertically spanned or oriented by the thread spanning guide 52 of the thread spanning mechanism 10.

As more clearly shown in FIGS. 2, 3 and 4, the thread anchoring mechanism 11 has a drive cylinder 63 secured to the carriage framework 12 and the piston rod 64 of the cylinder 63 has a bracket 65 secured thereto. A thread anchoring guide 66 is supported on the bracket 65 for slidable and rotational movement.

The piston rod 64 extends and retracts at right angles to the traverse guide 5 and thus, the thread anchoring guid 66 also extends and retracts together with the piston rod 64.

Integrally formed with the thread anchoring guide 66 is a guide bar 67 which extends parallel to the drive cylinder 63 and is received for slidable and rotational movement in the opening 69 in a guide sleeve 68 secured to the drive cylinder 63 in parallel to the drive cylinder 63.

The peripheral wall of the guide bar 67 is formed with axial parallel guide grooves 70, 71 at different phases and a slanted guide groove 72 connecting between the grooves 70, 71. Slidably received within these guide grooves 70, 71, 72 is an engaging pin 73 secured to the guide sleeve 68 and protruding into the opening 69 in the guide sleeve 68.

Thus, so long as the engaging pin 73 engages in the guide groove 70 as the piston rod 64 extends, the thread anchoring guide 66 moves linearly; when the engaging pin 73 engages in the guide groove 72, the thread anchoring guide 66 rotates to change its phase by 90°; and when the engaging pin 73 engages in the guide groove 71, the thread anchoring guide 66 advances linearly again, maintaining the change phase.

As more clearly shown in FIGS. 13 and 14, the thread anchoring guide 66 comprises a substantially L-shaped member including a thread arresting piece 74 extending in parallel to the guide bar 67 and a thread guide piece 75 extending from the base end of the thread arresting piece at right angles thereto. As more clearly shown in FIGS. 2, 3 and 13, the leading end of the thread arresting piece 74 is formed with a thread arresting groove 76 for arresting the thread spanned vertically as shown by reference numeral 62.

As mentioned hereinabove, when the engaging pin 73 on the guide sleeve 68 engages in the guide groove 70 in the guide bar 67, the arresting piece 74 assumes the horizontal position and the thread guide piece 75 assumes an upright position as shown in FIG. 13. When the thread anchoring guide 66 has completed its predetermined rotation, the thread arresting piece 74 assumes an upright position and the thread guide piece 75 assumed a horizontal position as shown in FIG. 14. Thus, the guide bar 67, guide grooves 70, 71, 72, guide sleeve 68, and engaging pin 73 constitute means for rotating the thread anchoring guide 66.

At the end of the retraction movement of the piston rod 64 of the drive cylinder 63 in the arrow Q direction in FIG. 3, the thread anchoring guide 66 assumes the position retracted inwardly toward the carriage 1 shown by the solid line in FIGS. 2 and 3 where the guide 66 does not interfere with the operation of the thread anchoring mechanism. On the other hand, at the end of the extending movement of the piston rod 64 in the arrow R direction in FIGS. 2 and 3, the thread arresting piece 74 of the thread anchoring guide 66 assumes a position outside of the thread anchoring disc 32 of the associated winder as shown by reference numeral 77 in FIGS. 2 and 3.

Figure 15:
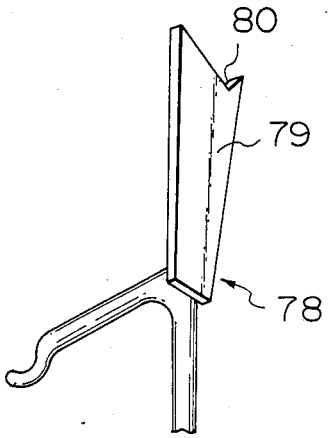
FIGS. 15, 16 and 17 are perspective views of different forms of thread arresting pieces useful in the apparatus of the invention, respectively.
Figure 16:
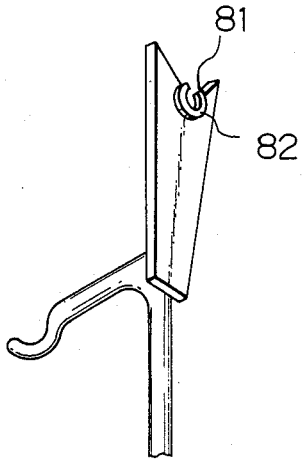

In place of the thread anchoring guide 66 illustrated and described hereinabove, a thread anchoring guide 78 comprising a thread arresting piece 79 provided with a thread arresting groove 80 near one side end of the leading end thereof as shown in FIG. 15 or a thread arresting piece provided with a thread arresting groove 81 to which a ceramic guide member 82 is attached as shown in FIG. 16 may be employed.

Figure 17:
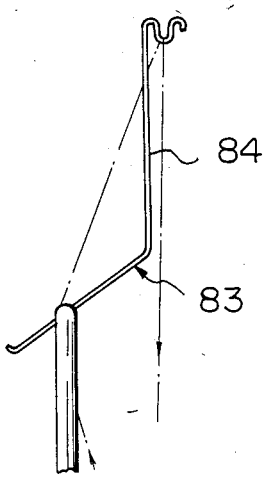

As a further alternative thread anchoring guide, the thread anchoring guide 83 shown in FIG. 17 is formed by folding a single rod to provide a thread arresting piece 84 and a thread guide piece 85.

Figure 18:
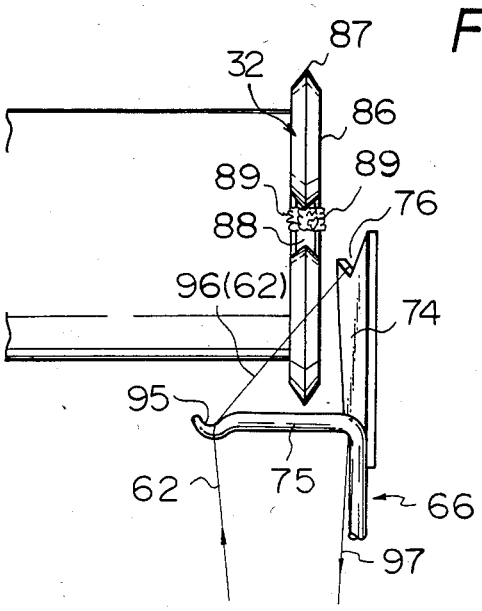
FIG. 18 is a plan view showing the thread anchoring operation by the thread anchoring mechanism.
Figure 19:
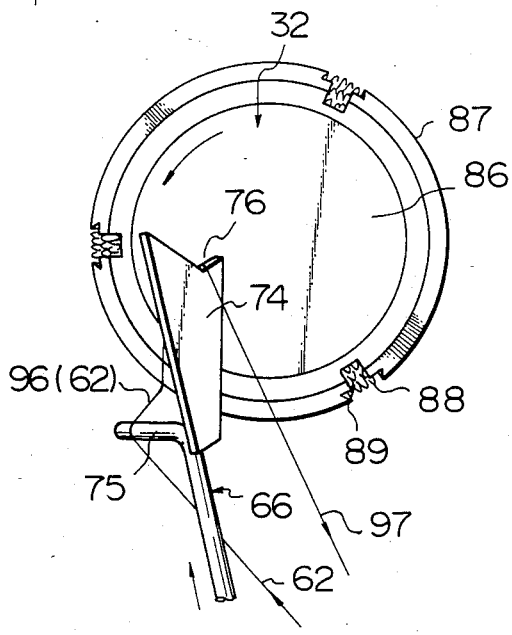
FIG. 19 is a side elevational view as seen from the right-hand side of FIG. 18.

As more clearly shown in FIGS. 3, 18 and 19, the edge-like periphery 87 of the disc body 86 is provided with a plurality of angularly spaced notches 88 serving as anchoring areas and thread anchoring members 89 in the form of a hook fastener are secured at the notches 88 straddling the thickness of the disc body 86.

As more clearly shown in FIG. 3, the oiling means 34 comprises an oiling roller 90 and a rocking lever 92 having a thread guide 91 the weight of which normally urges the lever in the arrow S direction so as to bring the thread 33 into contact with the oiling roller 90. On the other hand, as more clearly shown in FIGS. 2, 3, and 4, a drive cylinder 93 is secured to the carriage 1 and has a piston rod 94 the leading end of which is adapted to engage the lever 92 to rock the latter in the arrow T direction in FIG. 3 which in turn rotates the thread guide 91 upwardly as seen in FIG. 3 whereby the oiling operation is interrupted. As the piston rod 94 retracts, the rod disengages from the rocking lever 92 and the lever is allowed to rotate in the arrow S direction under the weight of the thread guide 91 to resume the oiling operation.

With the above-mentioned construction and arrangement of the components of the thread winding apparatus of the present invention, the apparatus operates as follows:

It is now assumed that both the piston rods 24 and 51 have fully extended, the piston rods 27, 48, 64 and 94 have fully retracted, and a full bobbin signal has been issued from any one particular winder out of the winders 2, 3, 4 . . . . The carriage 1 is run along the rails 8, 8 to a position facing the particular one winder and stopped in the position whereupon the piston rod 94 of the drive cylinder 93 is extended to engage and rotate the rocking lever 92 of the oiling device 34 to move the thread guide 91 to a position as shown in FIG. 3 to thereby interrupt the oiling operation to the thread 33.

Simultaneously, the drive cylinder 23 is actuated to retract the piston rod 24 in the arrow A direction as shown in FIG. 5 to rotate the spline shaft 13 in the arrow C direction through the connector bar 22. The rotation of the spline shaft 13 in the arrow C direction rotates the thread offsetting guide 15 on the slide 14 in the arrow I direction. At the end of the retraction movement of the piston rod 24, the thread offsetting guide 15 straddles the traverse guide 5 as shown by the chain line in FIG. 5.

Next, the drive cylinder 26 is actuated to extend the piston rod 27 in the arrow E direction whereupon the slide 14 embraced by the bracket 25 advances along the spline shaft 13 in the arrow G direction.

The advance of the slide 14 in the arrow G direction also moves the thread offsetting guide 15 in the arrow G direction. While the thread offsetting guide 15 is moving in the arrow G direction, the thread 33 traversing along the traverse guide 5 within the traverse range M abuts against the blade portion 20 on the thread pusher piece 19 of the thread offsetting guide 15 as shown in FIG. 3 to be offset in the arrow G direction.

As the piston rod 27 approches the end of its extending movement, the blade portion 20 on the thread pusher piece 19 approaches the side 46 of the sleeve 41 and abuts against the side 46 to push the sleeve 41. When the piston rod 27 reaches the end of its extending movement, the sleeve 41 moves while compressing the coil spring 45 to uncover the suction opening 40 in the traverse guide 5.

The suction opening 40 faces the thread anchoring disc 32 and thus, the thread 33 is offset by the blade portion 20 on the thread pusher piece 19 to the position where the thread faces the thread anchoring disc 32.

The offsetting of the thread 33 as mentioned hereinabove is the first step in the method of the present invention.

Figure 8:
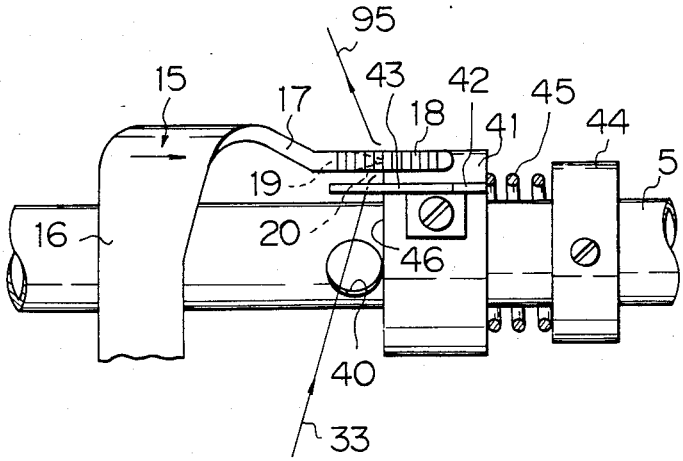
Figure 9:
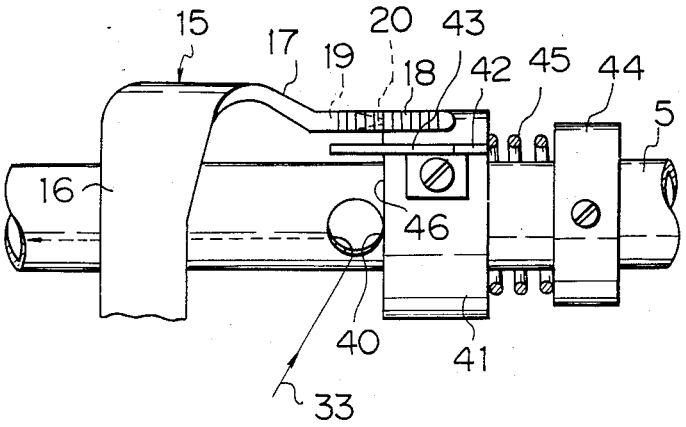
Figure 10:
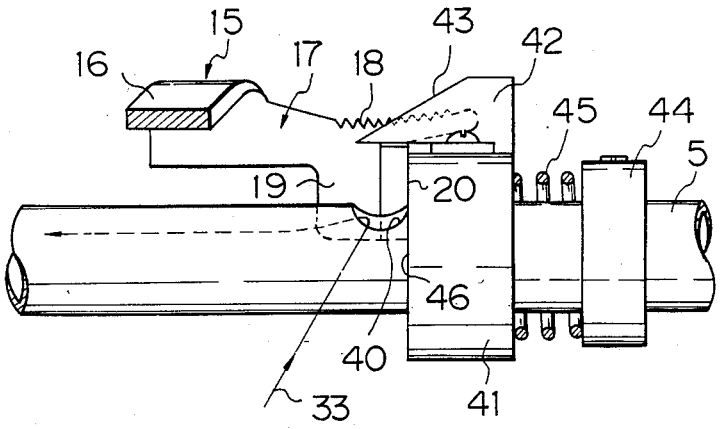
FIG. 10 is a front elevational view of FIG. 9.

The thus offset thread is firmly pinched between the blade portion 20 and the side face 46 on the sleeve 41 by the elastic restration force of the coil spring 45 and sheared off under the tension on the thread itself being wound about the bobbin 30 as shown in FIG. 8. The sheared end portion 95 is wound about the bobbin 30 whereas the remaining thread 33 is removed from the pinch area between the blade 20 and the side face 46 on the sleeve 41 by the vacuum applied through the opening 41 and is sucked into the traverse guide 5 through the suction opening 40 as shown in FIGS. 9 and 10. Under this condition, the remaining thread assumes a position as shown by reference numeral 33*a* in FIGS. 2 and 4.

Therafter, the drive cylinder 50 of the thread spanning mechanism 10 is actuated to retract the piston rod 51 in the arrow O direction as shown in FIG. 3 and the thread is engaged by the thread spanning guide 52 at the leading end of the piston rod 51 and maintained in the orientation shown by reference numeral 60 in FIGS. 2 and 3.

The drive cylinder 47 is then actuated to raise the piston rod 48 in the arrow P direction in FIG. 3 to thereby raise the drive cylinder 50 and thread spanning guide 52 through the bracket 49. At the end of the rising movement of the piston rod 48, the thread spanning guide 52 assumes a raised position as shown by reference numeral 61 in FIG. 3.

As the thread spanning guide 52 rises, the path of the thread shown by reference numeral 60 is regulated from above and below between the suction opening 40 in the traverse guide 5 and the thread spanning guide which now assumes the position 61 and the thread is spanned vertically as shown by reference numeral 62.

The step described just above is the second step in the method of the present invention.

With the thread spanned vertically as shown by reference numeral 62 in FIGS. 2, 3 and 13, the drive cylinder 63 of the thread anchoring mechanism 11 is actuated to extend the piston rod 64 in the arrow R direction in the next step of the method of the invention.

At an initial stage of the extending movement of the piston rod 64, the thread anchoring guide 66 at the leading end of the guide bar 67 is moved linearly to the state shown in FIG. 13 by the cooperation between the guide groove 70 in the guide bar 67 and the engaging pin 73 engaging in the groove and the thread engages in the groove 76 in the thread arresting piece 74 of the thread guide 66.

As the piston rod 64 further extends, the thread anchoring guide 66 is rotated to change its phase by 90° through the cooperation between the guide groove 72 and the engaging pin 73 engaging in the groove to orient the thread guide piece 75 to its horizontal position whereby the thread 62 extends slantly between the groove 76 in the thread arresting piece 74 and the thread guide portion 95 at the leading end of the thread guide piece 75 in the horizontal plane.

Figure 20:
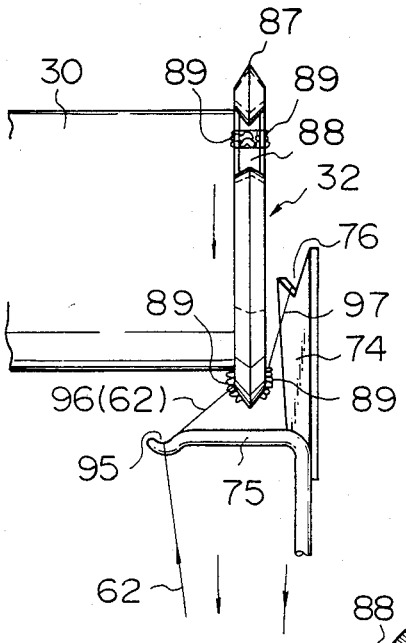
FIG. 20 is a plan view showing the thread anchoring disc of the apparatus in its thread anchoring condition.
Figure 21:
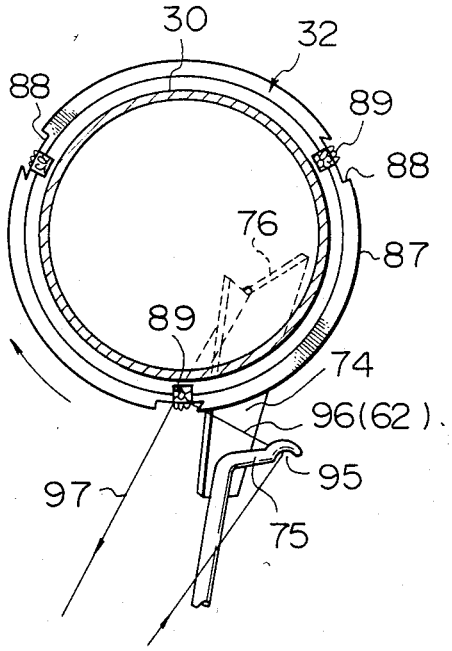
FIG. 21 is a side elevational view of FIG. 20 as seen from the left-hand side of FIG. 20 showing the bobbin in cross-section.

When the piston rod 64 has reached the end of its extending movement, the thread anchoring guide 66 is positioned outside the thread anchoring disc 32 as is more clearly shown in FIGS. 18 and 19 and the thread 62 or 96 extending between the groove 76 in the thread arresting piece 74 and the thread guide portion 95 of the thread guide piece 75 abuts against the periphery 87 of the disc body 86 and enters one of the notches 88 in the disc body as shown in FIGS. 20 and 21 as the disc 32 rotates to be anchored to the thread anchoring member 89 associated with the notch 88.

The thread 97 extending from the groove 76 in the thread arresting piece 74 to the suction opening 40 in the traverse guide 5 enters any one of the notches 88 and is anchored to the thread anchoring member 89 to be tensioned under suction whereby the thread is shered off at the periphery 87 of the disc body 86 and sucked into the suction opening 40.

The thread 96 anchored to the thread anchoring member 89 is wound about the bobbin 30 as the bobbin rotates as shown in FIG. 2.

The step described just above is the third step in the method of the present invention.

Figure 22:
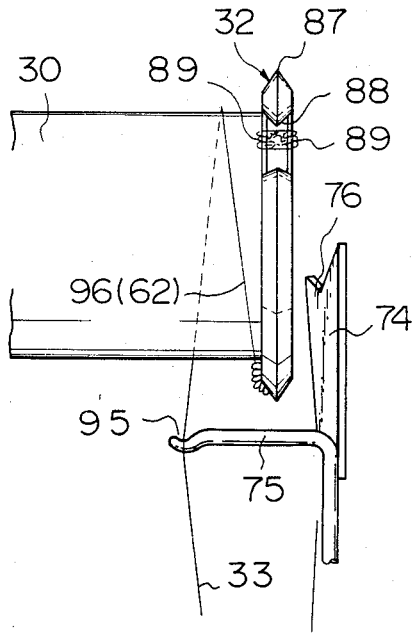
FIG. 22 is a plan view showing the thread anchored by the thread anchoring disc as being wound about a bobbin.

When the thread 96 has been wound about the bobbin 30 as shown in FIG. 22, the piston rod 64 retracts and the piston rod 48 descends down or retracts. When the piston rod 48 has reached to the end of its retraction movement, the piston rod 51 extends whereupon the thread anchoring guide 66 and thread spanning guide 52 return to their positions ready for operation and the piston rod 94 also retracts, so that the oiling means 34 may resume the oiling operation.

Figure 23:
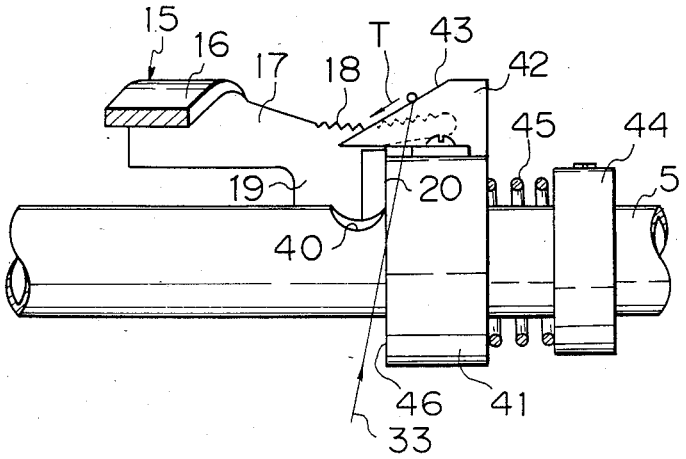
FIGS. 23 and 24 are fragmentary front elevational views showing the relationship between the thread offsetting mechanism and the thread being supplied from the thread supply source in successive steps after the thread anchoring operation has been completed.
Figure 24:
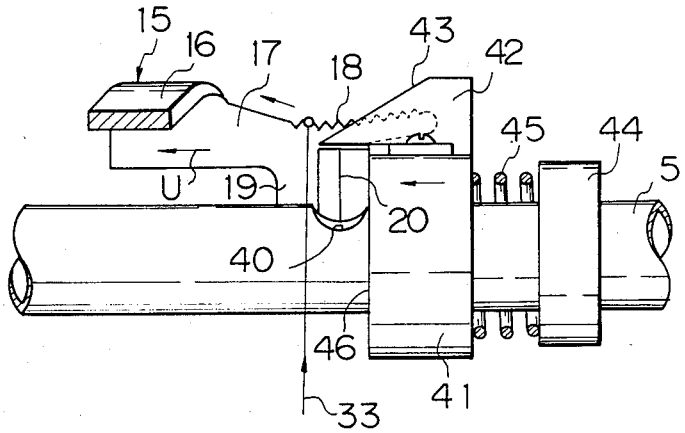

Thus, the thread 33 contiguous to the thread 96 as shown in FIG. 22 is loaded on the sleeve 41 and thereafter on the bent piece 17 of the thread offsetting guide 15 abutting to the sleeve as shown in FIG. 23.

That is, the thread 33 rides on the ramp 43 on the guide piece 42 of the sleeve 41 and slides down the ramp 43 in the arrow T direction onto the saw-toothed portion 18 of the bent piece 17 and is anchored to the saw-toothed portion 18.

At this stage of the operation, the piston rod 27 begins to retract and the slide 14 secured to the thread offsetting guide 15 slides back along the spline shaft 13 in the arrow H direction whereby the thread offsetting guide 15 moves in the arrow U direction and the thread 33 also moves in the arrow U direction, being carried on the saw-toothed portion 18 of the moving guide 15.

Midway in the retraction movement of the piston rod 27, when the thread 33 carried on the saw-toothed portion 18 on the guide 15 reaches the traverse range M, the thread 33 is arrested by the thread guide portion 37 of the reciprocating traverse means 36 as shown in FIG. 12 to be led into normal winding operation.

At the end of the retraction movement of the piston rod 27, the piston rod 24 extends to rotate the spline shaft 13 in the arrow D direction as shown in FIG. 5 whereby the slide 14 and thread offsetting guide 15 rotate to their ready positions, respectively and thus, the entire thread anchoring apparatus is ready for receiving the next full bobbin signal.

The step described just above is the fourth step of the method of the present invention.

As described hereinabove, according to the method of the present invention, the thread supplied from the supply source is positively arrested and wound about an empty bobbin without requiring an excessively wide space in front of a selected winder, interference between the thread anchoring member and bobbin is eliminated, and the path of the thread and the position of the thread anchoring member are not subjected to any limitation and can be freely set.

Also, according to the apparatus of the invention, the method of the invention can be conducted effectively, a sufficient space can be provided in front of a winder for conducting bobbin doffing and donning, the thread can be positively arrested and anchored without interference from the bobbin, and the thread anchoring apparatus may be made a relatively small size and perform thread anchoring efficiently in full automatic operation.

While only one embodiment of the invention has been shown and described in detail, it will be understood that the same is for the purpose of illustration only and is not to be taken as a definition of the invention, reference being had for this purpose to the appended claims.

We claim:

1. A thread anchoring method for anchoring thread to a winder comprising the steps of spanning a section of an indefinite length of thread supplied from a supply source in a predetermined direction by regulating the path of said thread extending from a stationary thread guide towards an empty bobbin in said winder, anchoring said thread section to an anchoring portion of a thread anchoring disc in said winder by arresting said thread section and protruding said thread section towards said thread anchoring disc, bringing said thread section extending between said thread guide and said anchoring portion on said disc into engagement with a traverse means and thereafter releasing said arresting of said thread section, characterized by the steps of offsetting said thread section extending from said thread guide to said bobbin to a position in which the thread section faces said thread anchoring disc at one end of said empty bobbin along and over a traverse guide of said traverse means, spanning said thread section vertically by regulating said path of thread from above and below, and anchoring said thread section to said anchoring disc by arresting said vertically spanned thread section at a point thereof, protruding said arrested thread section outwardly from said thread anchoring disc and displacing said thread section so that the thread section passes slantly from a position outward from the thread anchoring disc to said empty bobbin in horizontal plane.

2. A method as set forth in claim 1, including cutting said thread section at the point of offset of said thread section extending along and over said traverse guide.

3. A method as set forth in claim 2, further including holding the cut end portion of said thread section on said traverse guide.

4. A method as set forth in claim 3, in which the holding of the cut end portion of said thread section on said traverse guide is performed by sucking the cut end portion into the traverse guide through a suction hole in the traverse guide.

5. A method as set forth in claim 4, in which the vertical spanning of said thread section is performed by first holding said cut end portion of the thread section on said traverse guide, then engaging said thread section and raising the engaging point of said thread section.

6. A thread anchoring apparatus for anchoring thread to a winder comprising a stationary traverse guide positioned in front of said winder in spaced relationship to the winder and a carriage movable in parallel to said traverse guide, said carriage mounting a thread spanning mechanism for stretching a section of an indefinite length of thread supplied from a supply source in a predetermined direction by regulating the path of said thread section extending from a stationary thread guide to an empty bobbin in said winder in said predetermined direction and a thread anchoring mechanism for arresting and protruding said spanned thread section towards a thread anchoring disc having an engaging portion provided in said winder to thereby bring the thread section into engagement with said engaging portion, characterized by a thread offsetting mechanism mounted on said carriage and comprising a thread offsetting guide for engaging said thread section extending from said stationary thread guide towards said bobbin and drive means for reciprocally moving said thread offsetting guide between a first position in which the thread offsetting guide is positioned beyond one limit of the traverse range of said thread section and a second position in which the thread offsetting guide is positioned beyond the other limit of the traverse range of the thread section and is opposing said thread anchoring disc positioned at one end of said empty bobbin, said thread spanning mechanism being disposed in a position facing said thread section offset to the position opposing said thread anchoring disc by said thread offsetting mechanism and comprising a thread spanning guide for engaging said thread section and drive means for moving said thrad spanning guide vertically, the raised position of the thread spanning guide corresponding to said vertical spanning position of the thread section, said thread anchoring mechanism being provided in a position facing said thread section spanned vertically by said thread spanning mechanism and comprising a substantially L-shaped thread anchoring guide which includes a thread arresting piece having a groove for arresting said spanned thread section and a thread guide piece extending from the base end of said thread arresting piece at right angles thereto, drive means for reciprocally moving said thread anchoring guide between a retracted position near said carriage and an advanced position in which said thread arresting piece is positioned outwardly of said thread anchoring disc and means for rotating said thread anchoring guide so as to orientate said thread guide piece from a vertical position to a substantially horizontal position, said advanced position of the thread anchoring guide being so designed that said thread section extending from said thread arresting piece to said thread guide piece intersects said thread anchoring disc.

7. An apparatus as set forth in claim 6, in which said thread offsetting guide is secured to a slide slidable along a shaft pivoted to the framework of said carriage and extending in parallel to said traverse guide.

8. An apparatus as set forth in claim 7, in which said shaft is a spline shaft rotatable about the axis thereof.

9. An apparatus as set forth in claim 6, in which said thread offsetting guide includes a blade portion for engaging said thread section.

10. An apparatus as set forth in claim 6, in which said traverse guide is a hollow member having the hollow interior in communication with a vacuum source and has a suction hole positioned to align with said thread anchoring disc in said winder.

11. An apparatus as set forth in claim 10, in which said suction hole is normally closed by a sleeve slidably mounted on said traverse guide and when said thread offsetting guide is moved to said second position, said blade portion of the thread offsetting guide pushes said sleeve so as to uncover said suction hole.

12. An apparatus as set forth in claim 6, in which said thread spanning guide is movable between a first position in which the spanning guide is positioned just below said traverse guide and does not interfere with said thread section, a second position in which the spanning guide retracts from said first position onto said carriage and engages said thread section being supplied, and a third position in which the spanning guide is raised from said second position to span said thread section vertically.

13. An apparatus as set forth in claim 6, in which said means for rotating said thread anchoring guide comprises a guide bar secured to the thread anchoring guide so as to extend in the advancing and retracting directions of said anchoring guide, a spiral guide groove formed in the peripheral wall of said guide bar, and a stationary pin for engaging in said groove.

14. An apparatus as set forth in claim 6, in which said thread anchoring disc is formed with a plurality of notches in the peripheral edge of the disc and thread anchoring members in the form of face fastners are secured in said notches.

* * * * *